US005551621A

United States Patent [19]

Vallee

[11] Patent Number: 5,551,621

[45] Date of Patent: Sep. 3, 1996

[54] CONVERTIBLE CONTACT/SEQUENTIAL TRIP TRIGGER WITH DOUBLE ACTUATION PREVENTION STRUCTURE

[75] Inventor: Glenn E. Vallee, West Warwick, R.I.

[73] Assignee: Stanley-Bostitch, Inc., East Greenwich, R.I.

[21] Appl. No.: 449,099

[22] Filed: May 24, 1995

Related U.S. Application Data

[63] Continuation-in-part of Ser. No. 288,085, Aug. 10, 1994.

[51] Int. Cl.[6] ..... B25C 1/04

[52] U.S. Cl. ..... 227/8; 227/130; 227/120

[58] Field of Search ..... 227/8, 130, 147, 227/120, 131, 132

[56] References Cited

U.S. PATENT DOCUMENTS

| | | | |
|---|---|---|---|
| 4,716,813 | 1/1988 | Prundencio | 227/130 |
| 4,830,253 | 5/1989 | Hunter | 227/8 |
| 5,083,694 | 1/1992 | Lemos | 227/8 |

FOREIGN PATENT DOCUMENTS

| | | | |
|---|---|---|---|
| 0086244 | 8/1983 | European Pat. Off. | 227/8 |

*Primary Examiner*—Rinaldi I. Rada
*Assistant Examiner*—Allan M. Schrock
*Attorney, Agent, or Firm*—Cushman Darby & Cushman, L.L.P.

[57] ABSTRACT

A fastener driving tool includes an improved trigger assembly including control structure constructed and arranged to be manually movable between a sequential operating mode position and a contact operating mode position to cause the tool to operate in a sequential operating mode and a contact operating mode, respectively. The device includes a work piece contact responsive assembly carried by a housing and constructed and arranged for movement from a normal, inoperative position into an operative position in response to movement of the tool into cooperating engagement with the work piece. The control structure and the work piece contact responsive assembly cooperate to define actuation prevention structure constructed and arranged to prevent more than one cycle of tool operation from occurring during the sequential operating mode when only a single cycle of tool operation is intended.

10 Claims, 3 Drawing Sheets

CONVERTIBLE CONTACT/SEQUENTIAL TRIP TRIGGER WITH DOUBLE ACTUATION PREVENTION STRUCTURE

This is a continuation-in-part application of Ser. No. 08/288,085, filed on Aug. 10, 1994.

BACKGROUND OF THE INVENTION

This invention relates to a portable fastener driving tool and, more particularly, to a fastener driving tool which may be operated in either a sequential mode or a contact mode of operation.

Portable fastener driving tools are conventionally used in the construction industry to deliver nails or other type of fasteners into a work piece. These fastener driving tools are trigger actuated, and the triggers are usually provided with mechanisms to prevent firing of the tool under certain operating conditions. These fastener driving devices or tools typically include a housing defining a fastener drive track, a magazine assembly carried by the housing for receiving a supply of fasteners and feeding successive fasteners into the drive track, a fastener driving element mounted within the drive track for movement through repetitive cycles each of which includes a fastener drive stroke in one direction which a fastener within the drive track is engaged and moved outwardly of the drive track into the work piece, and return stroke. A drive piston is operatively connected with the fastener driving element for movement therewith and a trigger is carried by the housing and is constructed and arranged for movement from a normal, inoperative position into a operative position for initiating movement of the piston and the fastener driving element through a fastener drive stroke.

To insure that the trigger will not be actuated to drive the fastener until the tool is in engagement with the work piece, a conventional contact trip mechanism is employed which is carried by the housing adjacent a nose piece of the tool. The conventional contact trip is disposed so as to extend beyond the nose piece of the tool and must be depressed by engagement of the tool with the work piece in order for the tool to be fired in a contact mode. The contact trip includes a portion which is cooperable with a trigger lever such that movement of the trigger lever is totally prevented until the contact trip engages the work piece. Thus, the tool is prevented from being fired until the contact trip is engaged with the work piece. These conventional fastener driver tools do not require any particular operating sequence between the trigger and the contact trip mechanism. It is typically only necessary that the bottom contact trip be engaged and the trigger pulled before the tool can be fired.

In certain circumstances, it has been desired to prevent the tool from firing when the contact trip is engaged inadvertently when the trigger is pulled. For instance, when an operator is handling the tool and inadvertently bumps the contact trip when the trigger is held in the pull position, the tool will fire.

Various devices have been developed which will ensure that the tool will not be fired unless a proper operating sequence is followed. One of these mechanisms is disclosed in U.S. Pat. No. 4,629,106 to Howard. Howard discloses an actuating mechanism which permits the tool to be repeatedly fired by engagement of the contact trip mechanism, but once the trigger is subsequently released, the actuating mechanism must be recycled with the bottom contract trip mechanism actuated before the trigger is operated to permit another fastener to be driven. The trigger includes a push-button arrangement for permitting the tool to be fired in a contact or bottom trip mode. Thus, when the bottom trip mode is required, the button is moved inwardly before or after the trigger has been pulled. Thus, once the button has been moved inwardly, contact of the bottom trip mechanism when the trigger is depressed will fire the tool. However, this mechanism is subject to a deficiency in that the contact mode may be selected by inadvertent movement of the button when the trigger is not pulled. Thus, if the button is inadvertently moved inwardly and thereafter the trigger is pressed, inadvertent contact of the contact trip will fire the tool. Further, due to the structure of the conventional device, double actuation of the tool may occur inadvertently during the sequential mode of operation. Double firing or actuation of the tool, as herein defined, occurs when more than one cycle of tool operation results when only a single operating cycle is intended.

SUMMARY OF THE INVENTION

An object of the present invention is to provide a portable fastener driving tool which may be operated in either a contact or sequential mode of operation. The contact mode of operation can only be selected so long as the trigger assembly is in a pulled or actuated position. Release of the trigger assembly from the actuated position causes the tool to move to a sequential mode of operation. Double actuation of the device during the sequential mode of operation is prevented.

This objective is achieved by providing a fastener driving tool including a portable housing defining a fastener drive track, a magazine assembly carried by the housing for receiving a supply of fasteners and feeding successive fasteners into the drive track, a fastener driving element mounted within the drive track for movement through repetitive cycles, each of which includes a fastener drive stroke in one direction which a fastener within the drive track is engaged and moved outwardly of the drive track into a work piece, and a return stroke, a drive piston operatively connected with the fastener driving element for movement therewith, an actuating mechanism carried by the housing and being constructed and arranged for movement from a normal, inoperative position into an operative position for initiating movement of the piston and the fastener driving element through a fastener driving stroke, and a work piece contact responsive assembly carried by the housing and being constructed and arranged for movement from a normal, inoperative position into an operative position in response to movement of the tool into cooperating engagement with the work piece. The actuating mechanism includes an actuator movable from an inoperative position to an operative position for controlling movement of the piston and fastener driving element through a fastener driving stroke, and a trigger assembly pivotally connected to the housing and movable between an inoperative position and a manually actuated position for moving the actuator to its operative position. The trigger assembly includes control structure constructed and arranged to be manually movable between (1) a sequential operating mode position whereby movement of the contact responsive assembly to its operative position followed by movement of the trigger assembly to its actuated position moves the actuator to its operative position permitting the piston and fastener driving element to move through a fastener driving stroke, and movement of the trigger assembly to its actuated position prior to movement of the contact responsive assembly to its operative position prevents movement of the actuator to its operative position so that inadvertent movement of the contact responsive assembly will not actuate the fastener driving tool, and (2) a contact operating mode position whereby repeated movement of the contact responsive assembly to its operative position repeatedly moves the actuator to its operative position to move the piston and fastener driving element through successive fastener driving strokes only so long as the trigger assembly is in the actuated position. Release of the trigger assembly from the actuated position causes the control structure to move to its sequential operating mode position. The control structure is constructed and arranged to remain in its contact operating mode position only when the trigger assembly is in its actuated position. The control structure and the work piece contact responsive assembly cooperate to define actuation prevention structure constructed and arranged to prevent more than one cycle from occurring during a sequential mode of operation when only one cycle is intended.

Another object of the present invention is the provision of a fastener driving tool of the type described, which is simple in construction, economical to manufacture and effective in operation.

These and other objects of the present invention will become more apparent during the course of the following detailed description and appended claims.

The invention may best be understood with reference to the accompanying drawings wherein an illustrative embodiment is shown.

DETAILED DESCRIPTION OF THE PRESENT PREFERRED EXEMPLARY EMBODIMENT

Figure 1:
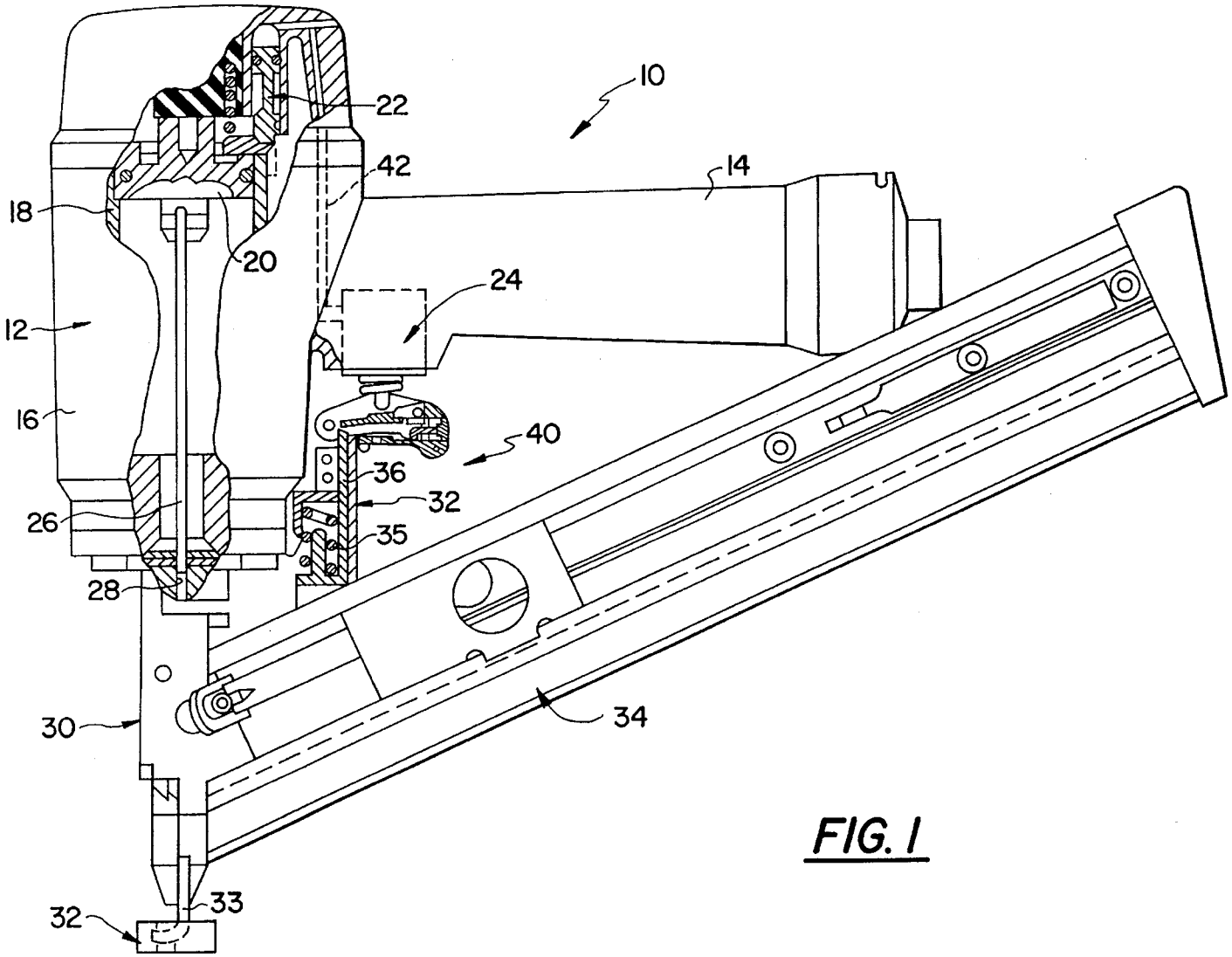
FIG. 1 is a side elevational view, with parts broken away for the purpose of clear illustration, of a portable power operated fastener driving tool embodying the principles of the present invention.

Referring now more particularly to the drawings, there is shown in FIG. 1 thereof a portable power operated fastener driving tool, generally indicated at 10, which embodies the principles of the present invention. The power operated tool 10 illustrated is of the fluid pressure operating type and includes the usual portable housing, generally indicated at 12, which includes a handle grip portion 14 of hollow configuration which constitutes a reservoir for air under pressure coming from a source which is communicated therewith. The forward end of the handle portion intersects with a main body portion 16 of the housing 12. Mounted within the main housing portion 16 is a cylindrical member 18 defining a cylindrical chamber within which a piston 20 is slidably sealingly mounted for movement from an upper position, as shown, through a drive stroke to a lower-most position and from the lower-most position through a return stroke back to its upper limiting position, defining an operating cycle. A main valve, generally indicated at 22, is provided for controlling communication of the reservoir pressure to the upper end of the cylinder to affect the driving movement of the piston. The main valve 22 is pilot pressure operated and the pilot pressure chamber thereof is under the control of a valve actuating mechanism generally indicated at 24. Means is provided within the housing 12 to affect the return stroke of the piston 20. For example, such means may be in the form of a conventional plenum chamber return system such as disclosed in U.S. Pat. No. 3,708,096, the disclosure of which is hereby incorporated into the present specification.

A fastener driving element 26 is suitably connected to the piston 20 and is slidably mounted within a drive track 28 formed in the nose piece assembly, generally indicated at 30, forming a fixed part of the housing 12.

A magazine assembly, generally indicted at 34 is fixed to the nose piece assembly 30 and is operable to receive a supply of fasteners and to feed the leading fastener of a supply into the drive track to be driven therefrom by the fastener driving element 26.

To prevent actuation of the tool 10 until it is engaged with a work piece, a work piece contact responsive assembly 32 is carried by the housing and is constructed and arranged for movement from a normal, inoperative position into an operative position in response to movement of the tool 10 into cooperating engagement with the work piece. The work piece contact responsive assembly 32 may assume a variety of different configurations. However, preferred construction is in accordance with the teachings contained in U.S. Pat. No. 4,767,043, the disclosure of which is hereby incorporated by reference into the present specification. As shown, the assembly 32 includes a work engaging member 33 which is spring pressed as by a spring 35 into a normal inoperative position extending below the end of the nose piece assembly 30 and moveable therefrom when the tool is moved into cooperating relation with the work piece into an operative position against the bias of the spring 35. The work piece contact responsive assembly 32 includes a moveable member 36 which is connected with the work engaging member 33 to move therewith so that it too moves between a normal inoperative position and an upward, operative position.

The valve actuating mechanism 24 includes a valve 37, an actuator 38 for actuating the valve 37 and a trigger assembly, generally indicated at 40, for moving the actuator 38. The valve 37 and actuator 38 may assume any desired configuration. However, a preferred construction is in accordance with the teachings contained in U.S. Pat. No. 5,083,694, the disclosure of which is hereby incorporated by reference into the present specification. In accordance with the usual practice, the main valve 22 is pressurized to move from a closed position into an open position when pressure in a pilot pressure chamber thereof is relieved. The pilot pressure is relieved or dumped to atmosphere through a passage 42 upon movement of the actuator 38 from inoperative position into operative position. The actuator 38 is mounted for rectilinear movement in a direction toward and away from the trigger assembly 40 which is disposed therebelow.

When the trigger assembly 40 is in its inoperative position, the supply of air under pressure within the hollow handle 14 of the housing 12 is able to pass through passage 42 which communicates with the pilot pressure chamber of the main valve 22. When the pilot pressure chamber is under pressure, the main valve 22 is in a closed position. When the pilot pressure is dumped to atmosphere upon moving the actuator 38 into its operative position, pressure acting on the main valve 22 moves the same into its open position which communicates the air pressure supply with the piston 20 to drive the same through its drive stroke together with the fastener driving element 26.

Figure 3:
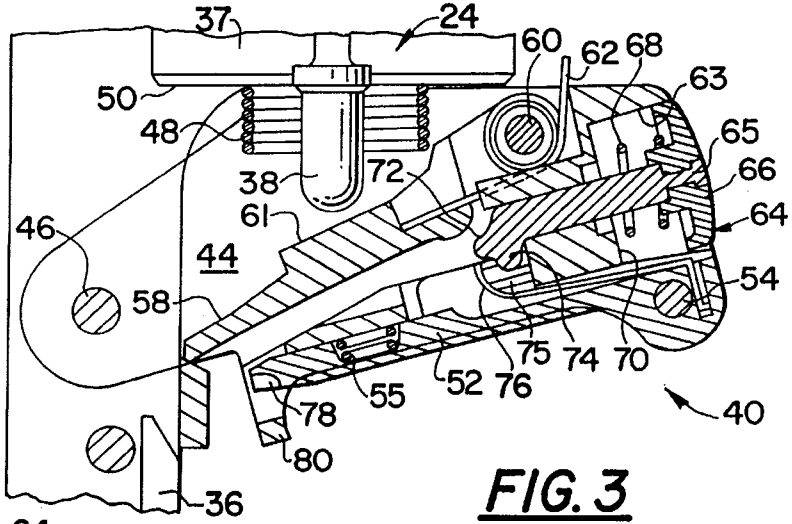
FIG. 3 is a view similar to FIG. 2, with the trigger assembly having been actuated prior to engagement of a contact responsive assembly with a work piece, preventing firing of the tool.
Figure 4:
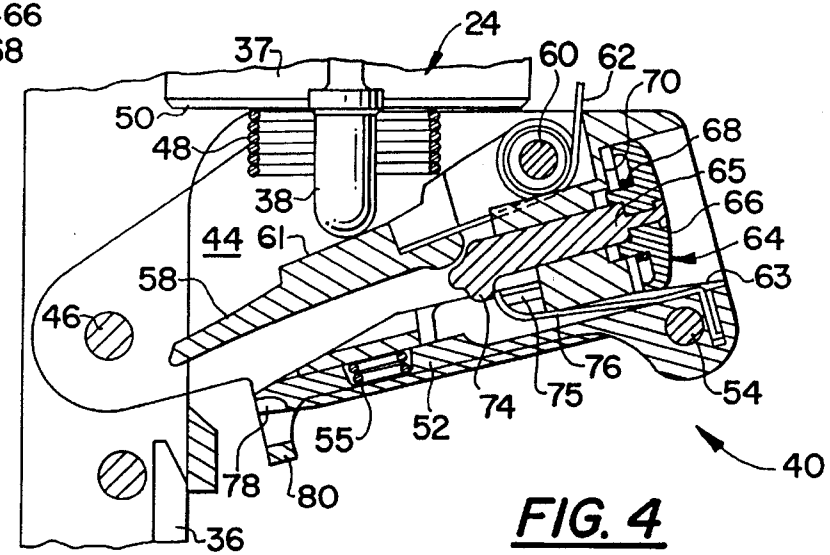
FIG. 4 is a view similar to FIG. 3, with the trigger assembly in a contact mode position whereby movement of a contact responsive assembly will fire the tool.
Figure 2:
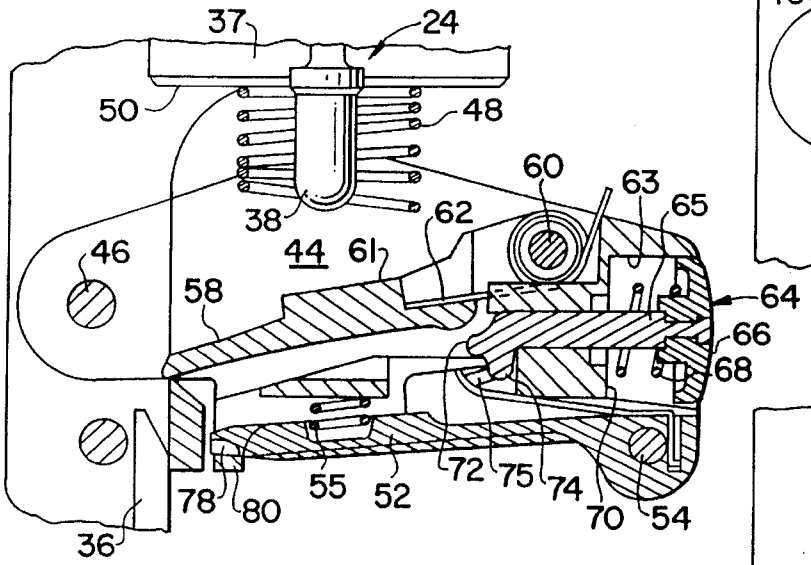
FIG. 2 is an enlarged partial sectional view of the trigger assembly of the device of FIG. 1, disposed in a non-actuated position.

The trigger assembly 40 includes a trigger member 44 which is of generally U-shaped cross-sectional configuration and includes forwardly extending mounting portions to which a pivot pin 46 is engaged so as to mount the trigger member 44 for pivotal movement about the axis of the pivot pin 46 with respect to the housing 12 between a normal, non-actuated position as shown in FIG. 2 and an actuated position as shown in FIGS. 3 and 4. The trigger member 44 is biased into its normal, non-actuated position by a spring 48 which is connected between the valve housing section 50 and the upper portion of the trigger member 44. The trigger assembly 40 includes a trigger lever 52 disposed at a lower portion thereof which is mounted for pivotal movement with respect to the trigger member 44 about the axis of a pivot pin 54, which pivotly couples the trigger lever 52 to the trigger member 44. The trigger lever 52 includes a recess therein which houses a coil spring 55 for biasing the trigger lever 52 downwardly. Thus, one end of the coil spring 55 is affixed to a surface of the trigger member 44 while the other end of the coil spring 55 engages the trigger lever 52. Trigger lever 52 is biased downwardly by spring 55 until recess 78 thereof engages protruding member 80 of the trigger member 44.

Trigger assembly 40 also includes a contact lever 58 which is mounted for pivotal movement with respect to the trigger member 44 about the axis of a pivot pin 60, which pivotly couples the contact lever 58 to the trigger member 44. As shown, the contact lever 58 is spaced from the trigger lever 52. A torsional coil spring 62 is positioned around the pivot pin 60 and has one end engaging the contact lever 58 and another end engaging the trigger member 44. The torsional spring 62 biases the contact lever 58 in a downward direction away from the actuator 38. An upper surface of the contact lever 58 includes a block portion 61 which is arranged to contact the actuator 38 so as to prevent double firing of the tool 10 when operating in a sequential mode of operation, which will become apparent below.

The trigger member 44 includes a rear wall portion which serves to define a recess 63 therein, within which is mounted control structure, including a slide assembly generally indicated at 64, mounted for rectilinear movement with respect to the trigger member 44. As shown, the slide assembly 64 includes a slide member 65 which is coupled to a manually movable button member 66 at one end thereof. The slide member 65 extends between the contact lever 58 and the trigger lever 52. The control structure also includes a coil spring 68 coupled to the button member 66 at one end thereof and the other end of the conical spring 68 is affixed to surface 70 of trigger member 44. The conical spring 68 acts to bias the slide assembly 64 outwardly towards the rear of the trigger member 44. The button member 66 is sized so as to be moveable within recess 63 of the trigger member 44. A distal portion of the slide member 65 includes a camming surface 72 (FIG. 3) which engages with the contact lever 58 when the slide member 65 is in an inward position (FIG. 4), which will become apparent below. The distal portion of the slide member 65 also includes a generally rounded protuberance 74 extending therefrom.

The trigger lever 52 includes a locking member in the form of a leaf spring 76 fixed to an end thereof adjacent projection 75 of the trigger lever 52 and near protuberance 74. Projection 75 limits the upward movement of the leaf spring 76. The leaf spring 76 is utilized to prevent the slide assembly 64 from moving towards its outward position when disposed in a contact mode of operation, as will become more apparent below.

The operation of the tool 10 will be apparent from FIGS. 1–4. FIG. 2 shows the trigger assembly 40 in a non-actuated position. If the contact responsive assembly 32 is first engaged with the work piece and the trigger assembly 40 is thereafter actuated, the tool will fire. In this position, the slide assembly 64 is biased outwardly by conical spring 68 so that the button member 66 is generally flush with a rear portion of the trigger member 44. With reference to FIG. 3, the trigger assembly 40 is shown to have been actuated prior to engaging the contact responsive assembly 32 with the work piece. Thus, with the slide assembly 64 in its outward position, if the trigger assembly 40 is actuated or pulled upwardly before the contact responsive assembly 32 is depressed or engaged with the work piece, the contact lever 58 will rotate downwardly due to the bias of the torsion spring 62 and into a position where the contact lever 58 cannot be engaged by the movable member 36 of the contact responsive assembly 32. Thus, the tool will not fire. However, as noted above, if the proper operating sequence is followed by first depressing the work engaging member 33 of the contact responsive assembly 32 before the trigger assembly 40 is pulled, for example, when the trigger assembly 40 is forced in the downward position by the trigger spring 48, then the movable member 36 moves upwardly and engages the contact lever 58, rotating it upwardly. If the trigger assembly 40 is then actuated, the block portion 61 of the contact lever 58 moves the actuator 38 upwardly, firing the tool 10.

When the slide assembly 64 is manually moved inwardly by employing a manually force on the button member 66 to overcome the bias of spring 68, the trigger assembly 40 is in a contact mode of operation (FIG. 4). The slide assembly 64 can only be locked inwardly when the trigger assembly 40 is actuated, since when the trigger assembly 40 is actuated, the leaf spring 76 is in a position with respect to the slide assembly 64 so as to prevent the slide assembly 64 from moving outwardly. With the button member 66 disposed inwardly and the trigger assembly 40 actuated, the trigger lever 52 rotates about pivot 54 into the trigger member 44, or upwardly with reference to FIG. 4, against the bias of spring 55, causing the leaf spring 76 to engage a surface of the protuberance 74, which prevents the conical spring 68 from pushing the slide assembly 64 to its outward position. However, if the trigger assembly 40 is released, the spring 55 forces the trigger lever 52 to rotate out of the trigger member 44, or downwardly, disengaging the leaf spring 76 from engagement with the protuberance 74 of the slide assembly 64. This permits the conical spring 68 to push the slide assembly 64 outwardly, again to the sequential mode operating position (FIG. 3).

In the contact mode of operation, the camming surface 72 of the slide member 65 is in contact with the contact lever 58 preventing the same from rotating downwardly and out of the travel path of the movable member 36. Consequently, the movable member 36 always engages the contact lever 58, so actuation is achieved when the movable member is in its upward position, independent of order.

Figure 5:
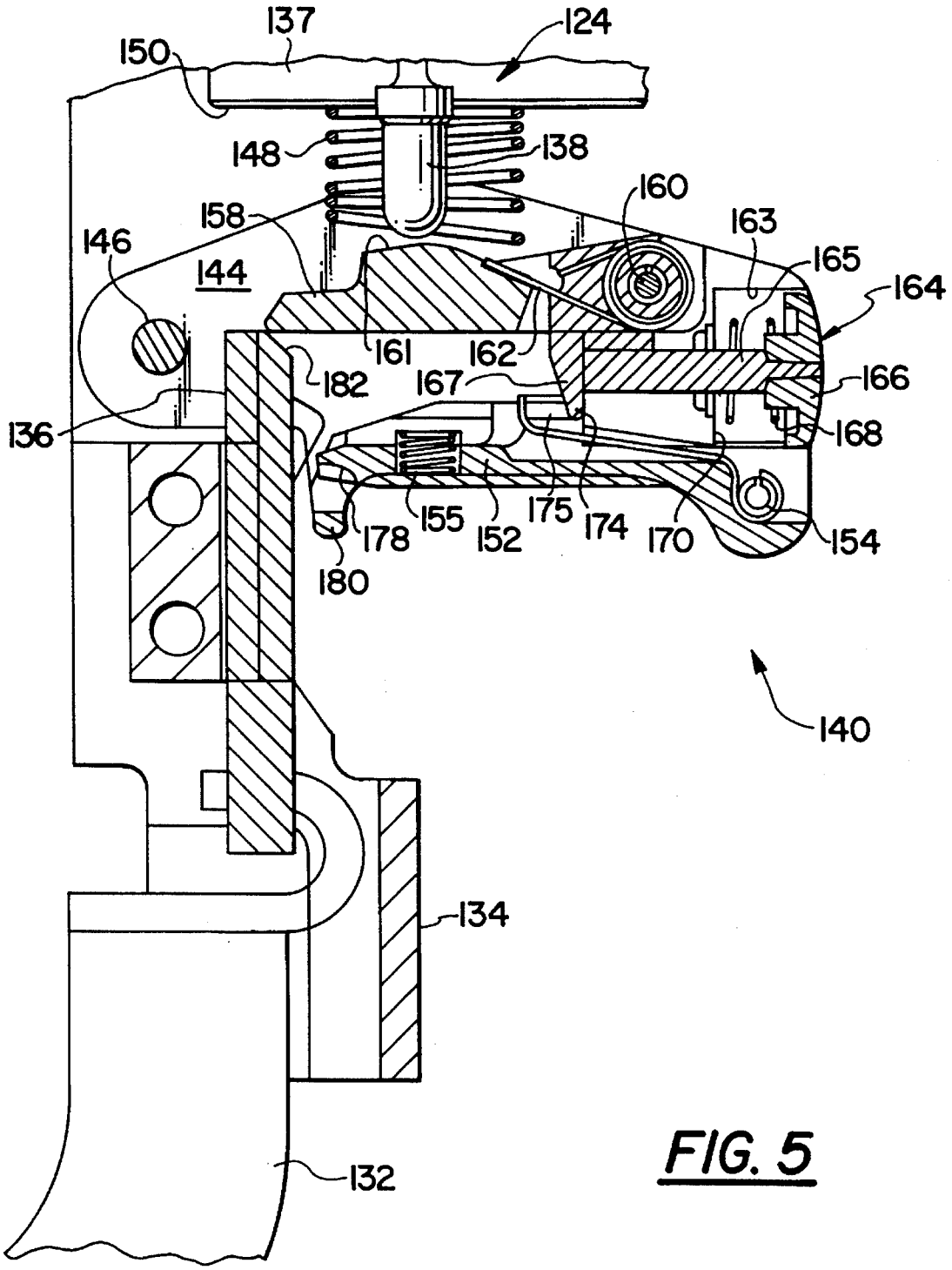
FIG. 5 is an enlarged partial sectional view similar to FIG. 2, of a second embodiment of the trigger assembly disposed in a non-actuated position.

A second embodiment of the trigger assembly 140 is shown in FIG. 5. As with the embodiment of FIGS. 2–4, the trigger assembly 140 includes a trigger member 144 which is of generally U-shaped cross-sectional configuration and includes forwardly extending mounting portions to which a pivot pin 146 is engaged so as to mount the trigger member 144 for pivotal movement about the axis of the pivot pin 146 with respect to the housing between a normal, non-actuated position as shown in FIG. 5 and an actuated position (not shown). The trigger member 144 is biased into its normal, non-actuated position by a spring 148 which is connected between the valve housing section 150 and the upper portion of the trigger member 144. The trigger assembly 140 includes a trigger lever 152 disposed at a lower portion thereof which is mounted for pivotal movement with respect to the trigger member 44 about the axis of a pivot pin 154, which pivotly couples the trigger lever 152 to the trigger member 44. As in the previous embodiment, the trigger lever 152 includes a recess therein which houses a coil spring 155 for biasing the trigger lever 152 downwardly.

The trigger member 144 includes a rear wall portion which serves to define a recess 163 therein, within which is mounted control structure, including a slide assembly generally indicated at 164, mounted for rectilinear movement with respect to the trigger member 144, and a contact lever 158. The contact lever 158 is mounted for pivotal movement about pin 160 at a boss portion of the contact lever 158 such that the contact lever 158 may pivot with respect to the trigger member 144. A torsional coil spring 162 is positioned around the pivot pin 160 and has one end engaging the contact lever in a downward direction away from the actuator 138. An upper surface of the contact lever 158 includes a block portion 161 which is arranged to contact the actuator 138 so as to prevent double firing of the tool 10 when operating in a sequential mode of operation, which will become apparent below.

As shown, the slide assembly 164 includes the slide member 165 which is coupled to a manually movable button member 166 at one end thereof and to leg portion 167 of contact lever 158 at the other end thereof. Thus, the contact lever 158 slides with the slide member 165. The distal portion of the leg portion 167 includes a generally rounded protuberance 174 extending therefrom which functions similarly to protuberance 74 of the trigger assembly of FIGS. 2–4.

The control structure also includes a coil spring 168 coupled to the button member 166 at one end thereof and the other end of the conical spring 168 is affixed to surface 170 of trigger member 144. The conical spring 168 acts to bias the slide assembly 164 outwardly towards the rear of the trigger member 144. The button member 166 is sized so as to be moveable within recess 163 of the trigger member 144.

The trigger lever 152 includes a locking member in the form of a leaf spring 176 fixed to a pin 154 and extending adjacent to projection 175 of the trigger lever 152, near protuberance 174 Projection 175 limits the upward movement of the leaf spring 176. The leaf spring 176 is utilized to prevent the contact lever 158 and slide assembly 164 from moving towards an outward position when disposed in a contact mode of operation by engaging the protuberance 174 in a manner similar to the engagement of protuberance 74, as in FIG. 4.

The work piece contact responsive assembly 132 includes a lifter or moveable member 136, which is moveable between a normal inoperative position and an upward, operative position as discussed above. As shown in FIG. 5, a guide member 134 is provided to guide the moveable member 136 so that it may move reciprocally, upwardly and downwardly, such that the surface 182 of the moveable member 136 may contact the contact lever 158 accurately.

The slidable contact lever 158 of the control structure and the work piece contact responsive member 132 including the moveable member 136 and the guide member 134, cooperate to define double actuation prevention structure. That structure prevents double actuation of the tool under all circumstances when in the sequential mode of operation, as explained below more fully.

The trigger assembly 140 works the same as in the embodiment of FIGS. 2–4 in that when the button member 166 is forward, adjacent surface 170, the contact mode of operation is active and when the button member 166 is in a position similar to that shown in FIG. 4, the default, sequential mode of operation is active. When the trigger member 144 is released, the tool defaults to the sequential mode of operation.

To prevent double actuation of the tool, the contact lever 158 slides with the slide member 165 so as to ensure that surface 161 of the contact lever 158 is aligned with the actuator 138. Further, since the moveable member 136 is guided by a guide member 134, the lifter 136 locates the position of surface 182, which moves the contact lever 158, more accurately. Thus, with this structure, surface 161 contacts the actuator 138 in such a manner to prevent more than one cycle of operation from occurring during the sequential operating mode, when only a single cycle of operation was intended.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all of the modifications encompassed within the spirit and scope of the following claims.

What is claimed is:

1. A fastener driving tool comprising:

a portable housing defining a fastener drive track, a magazine assembly carried by the housing for receiving a supply of fasteners and feeding successive fasteners into the drive track.

a fastener driving element mounted within the drive track for movement through repetitive cycles, each of which includes a fastener drive stroke in one direction which a fastener within the drive track is engaged and moved outwardly of the drive track into a work piece, and a return stroke, a drive piston operatively connected with the fastener driving element for movement therewith, an actuating mechanism carried by said housing and being constructed and arranged for movement from a normal, inoperative position into an operative position for initiating movement of said piston and said fastener driving element through a fastener driving stroke, and a work piece contact responsive assembly carried by said housing and being constructed and arranged for movement from a normal, inoperative position into an operative position in response to movement of said tool into cooperating engagement with the work piece, said actuating mechanism including an actuator movable from an inoperative position to an operative position for controlling movement of said piston and fastener driving element through a fastener driving stroke, and a trigger assembly pivotally connected to said housing and movable between an inoperative position and a manually actuated position for moving said actuator to its operative position, said trigger assembly including control structure constructed and arranged to be manually movable between (1) a sequential operating mode position whereby movement of said contact responsive assembly to its operative position followed by movement of said trigger assembly to its actuated position moves said actuator to its operative position permitting said piston and fastener driving element to move through a fastener driving stroke, and movement of said trigger assembly to its actuated position prior to movement of said contact responsive assembly to its operative position prevents movement of said actuator to its operative position so that inadvertent movement of said contact responsive assembly will not actuate the fastener driving tool, and (2) a contact operating mode position whereby repeated movement of said contact responsive assembly to its operative position repeatedly moves said actuator to its operative position to move said piston and fastener driving element through successive fastener driving strokes only so long as said trigger assembly is in said actuated position, release of said trigger assembly from said actuated position causing said control structure to move to its sequential operating mode position, said control structure being constructed and arranged to remain in its contact operating mode position only when said trigger assembly is in its actuated position, said control structure and said work piece contact responsive assembly cooperating to define actuation prevention structure constructed and arranged to prevent more than one cycle from occurring during a sequential mode of operation when only one cycle is intended, wherein said trigger assembly includes:

a trigger member pivotally coupled to the housing, a trigger lever pivotally coupled to a proximal end of said trigger member, said trigger lever including a locking member extending therefrom for locking said control structure in its contact operating mode position, and wherein said control structure includes:

a slide assembly and a spring for biasing said slide assembly towards a sequential operating mode position, contact lever coupled to said slide assembly for movement therewith and pivotally coupled to the proximal end of said trigger assembly at a position spaced from said trigger lever, and torsional spring operatively coupled to said contact lever for biasing the contact lever away from said actuator, whereby (1) when said control structure is disposed in its sequential operating mode position and the trigger assembly is moved to its actuated position prior to moving said contact responsive assembly to its operative position, said contact lever is biased by said torsional spring so that said contact lever may not be engaged by said contact responsive assembly, and when said contact responsive assembly is moved to its operative position followed by movement of said trigger assembly to its actuated position, said contact responsive assembly engages said contact lever, said contact lever thereafter engages said actuator permitting the piston and fastener driving element to move through a fastener driving stroke, and (2) when said control structure is locked by said locking member in its contact operating mode position, so long as said trigger assembly is in said actuated position, said contact lever is oriented so as to be in position to be moved by said contact responsive assembly such that movement of said contact responsive assembly while said trigger assembly remains in its actuated position moves said contact lever so as to engage said actuator permitting the piston and fastener driving element to move through a fastener driving stroke, release of said trigger assembly releases said locking member so that the said spring biases said control structure to its sequential operating position.

2. A fastener driving tool as defined in claim 1, wherein said slide assembly includes a slide member and a manually engageable button member coupled to a proximal end of said slide member, a distal end of said slide member being coupled to said contact lever, said button member being disposed within a recess of said trigger member and being constructed and arranged to be manually movable between sequential and contact operating mode positions.

3. A fastener driving tool as defined in claim 2, wherein said spring is a conical spring disposed between a surface of said recess and a surface of said button member.

4. A fastener driving tool as defined in claim 2, wherein a portion of said contact lever adjacent said slide member includes a protuberance, said locking member contacting a surface of said protuberance when said control structure is in its contact operating mode position so as to prevent said control structure from being biased to its sequential operating mode position by said spring, said locking member being constructed and arranged to be disengaged with said surface of said protuberance when said control structure is moved to its sequential operating mode position.

5. A fastener driving tool as defined in claim 4, wherein said locking member is a leaf spring.

6. A fastener driving tool as defined in claim 1, wherein said work piece contact responsive assembly includes a movable member and a guide member, said moveable member being guided for reciprocal movement by said guide member so as to contact said contact lever, and said contact lever includes a surface constructed and arranged to contact said actuator, said moveable member, said guide member and said contact lever cooperating to define said actuation prevention structure to prevent more than one cycle from occurring during the sequential mode of operation when only a single cycle is intended, by ensuring that said surface contacts the actuator only when intended.

7. A fastener driving tool as defined in claim 1, wherein a spring is provided between a surface of said trigger member and said trigger lever for biasing said trigger lever in a direction away from said contact lever.

8. A fastener driving tool comprising:

a portable housing defining a fastener drive track, a magazine assembly carried by the housing for receiving a supply of fasteners and feeding successive fasteners into the drive track, a fastener driving element mounted within the drive track for movement through repetitive cycles, each of which includes a fastener drive stroke in one direction which a fastener within the drive track is engaged and moved outwardly of the drive track into a work piece, and a return stroke, a drive piston operatively connected with the fastener driving element for movement therewith, an actuating mechanism carried by said housing and being constructed and arranged for movement from a normal, inoperative position into an operative position for initiating movement of said piston and said fastener driving element through a fastener driving stroke, and a work piece contact responsive assembly carried by said housing and being constructed and arranged for movement from a normal, inoperative position into an operative position in response to movement of said tool into cooperating engagement with the work piece, said actuating mechanism including an actuator movable from an inoperative position to an operative position for controlling movement of said piston and fastener driving element through a fastener driving stroke, and a trigger assembly pivotally connected to said housing and movable between an inoperative position and a manually actuated position for moving said actuator to its operative position, said trigger assembly including control structure constructed and arranged to be manually movable between a sequential operating mode position and a contact operating mode position to cause said tool to operate in a sequential operating mode and a contact operating mode, respectively, said control structure and said work piece contact responsive assembly cooperating to define actuation prevention structure constructed and arranged to prevent more than one cycle from occurring during the sequential operating mode when only one cycle is intended, wherein said trigger assembly includes:

a trigger member pivotally coupled to the housing, a trigger lever pivotally coupled to a proximal end of said trigger member, said trigger lever including a locking member extending therefrom for locking said control structure in its contact operating mode position, and wherein said control structure includes:

a slide assembly and a spring for biasing said slide assembly towards a sequential operating mode position, a contact lever coupled to said slide assembly for movement therewith and pivotally coupled to the proximal end of said trigger assembly at a position spaced from said trigger lever, and a torsional spring operatively coupled to said contact lever for biasing the contact lever away from said actuator, whereby (1) when said control structure is disposed in its sequential operating mode position and the trigger assembly is moved to its actuated position prior to moving said contact responsive assembly to its operative position, said contact lever is biased by said torsional spring so that said contact lever may not be engaged by said contact responsive assembly, and when said contact responsive assembly is moved to its operative position followed by movement of said trigger assembly to its actuated position, said contact responsive assembly engages said contact lever, said contact lever thereafter engages said actuator permitting the piston and fastener driving element to move through a fastener driving stroke, and (2) when said control structure is locked by said locking member in its contact operating mode position, so long as said trigger assembly is in said actuated position, said contact lever is oriented so as to be in position to be moved by said contact responsive assembly such that movement of said contact responsive assembly while said trigger assembly remains in its actuated position moves said contact lever so as to engage said actuator permitting the piston and fastener driving element to move through a fastener driving stroke, release of said trigger assembly releases said locking member so that the said spring biases said control structure to its sequential operating position.

9. A fastener driving tool as defined in claim 8, wherein said slide assembly includes a slide member and a manually engageable button member coupled to a proximal end of said slide member, a distal end of said slide member being coupled to said contact lever, said button member being disposed within a recess of said trigger member and being constructed and arranged to be manually movable between sequential and contact operating mode positions.

10. A fastener driving tool as defined in claim 8, wherein said work piece contact responsive assembly includes a movable member and a guide member, said moveable member being guided for reciprocal movement by said guide member so as to contact said contact lever, and said contact lever includes a surface constructed and arranged to contact said actuator, said moveable member, said guide member and said contact lever cooperating to define said actuation prevention structure to prevent more than one cycle from occurring during the sequential operating mode when only a single cycle is intended, by ensuring said surface contacts the actuator only when intended.

* * * * *